US007199766B2

(12) United States Patent
Lin

(10) Patent No.: US 7,199,766 B2
(45) Date of Patent: Apr. 3, 2007

(54) STRUCTURE FOR AN EDGE OF A DISK BODY OF AN ANTENNA

(76) Inventor: Shu Fua Lin, No. 1000, Guangfu Rd., Bade City, Taoyuan County (TW) 334

( * ) Notice: Subject to any disclaimer, the term of this patent is extended or adjusted under 35 U.S.C. 154(b) by 0 days.

(21) Appl. No.: 11/090,427

(22) Filed: Mar. 28, 2005

(65) Prior Publication Data

US 2006/0214870 A1 Sep. 28, 2006

(51) Int. Cl.
*H01Q 15/14* (2006.01)

(52) U.S. Cl. ..... 343/914; 343/912
(58) Field of Classification Search ..... 343/912–916
See application file for complete search history.

(56) References Cited

U.S. PATENT DOCUMENTS 5,134,423 A * 7/1992 Haupt ..... 343/912
5,532,710 A * 7/1996 Rodeffer ..... 343/912

* cited by examiner

*Primary Examiner*—Hoang V. Nguyen
*Assistant Examiner*—Ephrem Alemu
(74) *Attorney, Agent, or Firm*—Birch, Stewart, Kolasch & Birch, LLP

(57) ABSTRACT

An improved structure for an edge of a disk body of an antenna. The antenna includes the disk body and a side portion. The side portion has a supporting ring and a containing slot surrounding the circumference of the disk body. The supporting ring is on a top of the side portion, therefore the supporting ring of a bottom antenna is reserved in the containing slot of a top antenna while stacking a plurality of antennas sequentially in an order.

2 Claims, 3 Drawing Sheets

STRUCTURE FOR AN EDGE OF A DISK BODY OF AN ANTENNA

FIELD OF THE INVENTION

The present invention relates to an improved structure for an edge of a disk body of an antenna, especially to the structure circularly having a supporting ring and a containing slot on the disk body of the antenna.

BACKGROUND OF THE INVENTION

Please refer to FIG. 1 and FIG. 2, which are a sectional sketch of an edge of an antenna in prior arts and a sectional sketch for stacking a plurality of antennas in prior arts. Originally the edge of the antenna is assembled by a supporting ring 110 and a base 120 holding the supporting ring 110. The antennas may be stacked flat for delivery after manufacturing. Due to the wide angle between a bottom edge 121 and a side edge 122 of the base 120 greater than 90 degrees making the condition of the slippery supporting ring 110 of a bottom antenna 100 and the supporting ring 110 of the bottom antenna 100 sustaining the base 120 of a top antenna 100 via only a point 123 while in stacking, the top antenna 100 may then be unstable to fall down as the position of an antenna 100'. Therefore to design a structure for firmly stacking antennas and preventing the conditions of damage to the antennas and occupying the space of a container shall be a very important issue.

SUMMARY OF THE INVENTION

The primary objective of the present invention is to provide an improved structure for an edge of a disk body of an antenna, wherein a containing slot is designed on a side edge of a base of the antenna, so a supporting ring of a bottom antenna being reserved in the containing slot of a top antenna while in stacking. Such that, the antennas are stacked firmly to avoid damage by falling down and not occupying too much room in a container.

The improved structure of the present invention comprises the disk body and the side edge, the side edge having the supporting ring and the containing slot is around the disk body, the supporting ring is on the top of the side edge, therefore the supporting ring of the bottom antenna being reserved in the containing slot of the top antenna while stacking a plurality of antennas, and the plurality of antennas are stacked in order.

BRIEF DESCRIPTION OF THE DRAWINGS

The above objective, features and other advantages of the present invention will be more clearly understood from the following detailed description taken in conjunction with the accompanying drawings, in which.

DESCRIPTION OF THE PREFERRED EMBODIMENTS

The present invention will now be described in detail with reference to the preferred embodiments and the annexed drawings.

Figure 1:
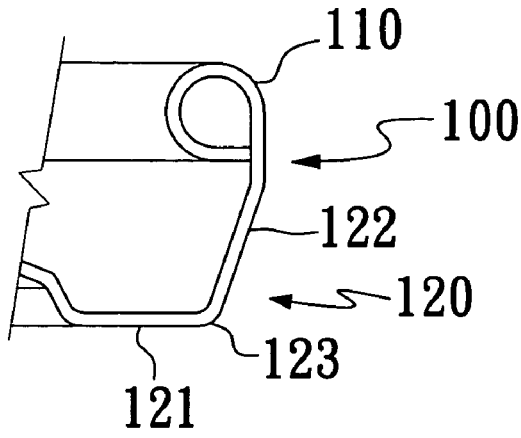
(PRIOR ART) Fig. 1
FIG. 1 is a sectional sketch of an edge of an antenna in prior arts.
Figure 2:
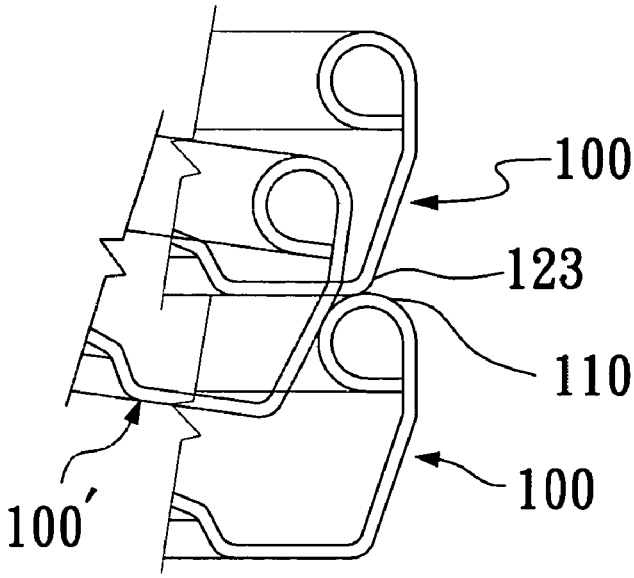
(PRIOR ART) Fig. 2
FIG. 2 is a sectional sketch for stacking a plurality of antennas in prior arts.
Figure 3:
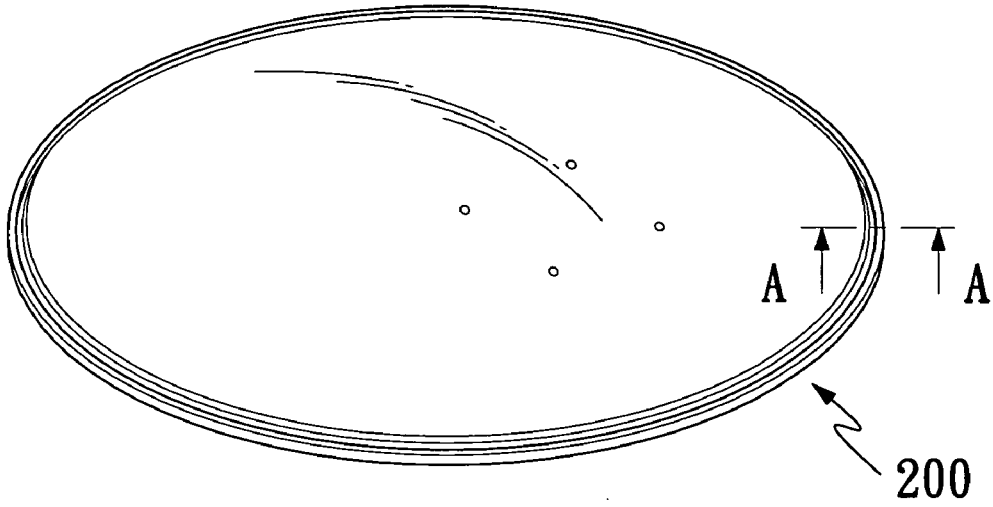
FIG. 3 is a 3-D sketch of the present invention.
Figure 4:
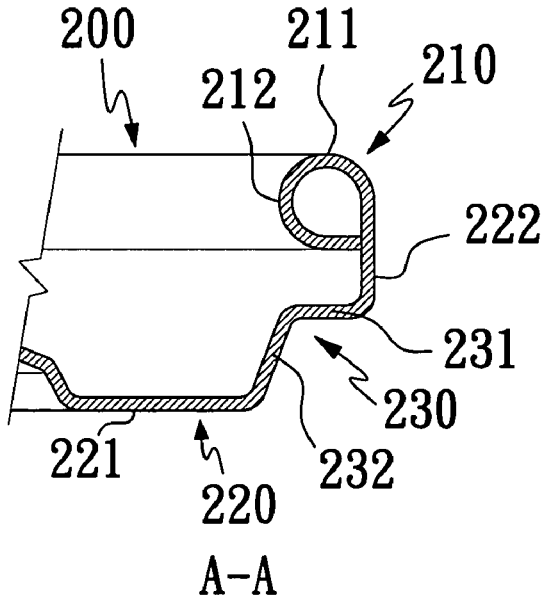
FIG. 4 is a sectional sketch of a cross line AA' of FIG. 3.
Figure 5:
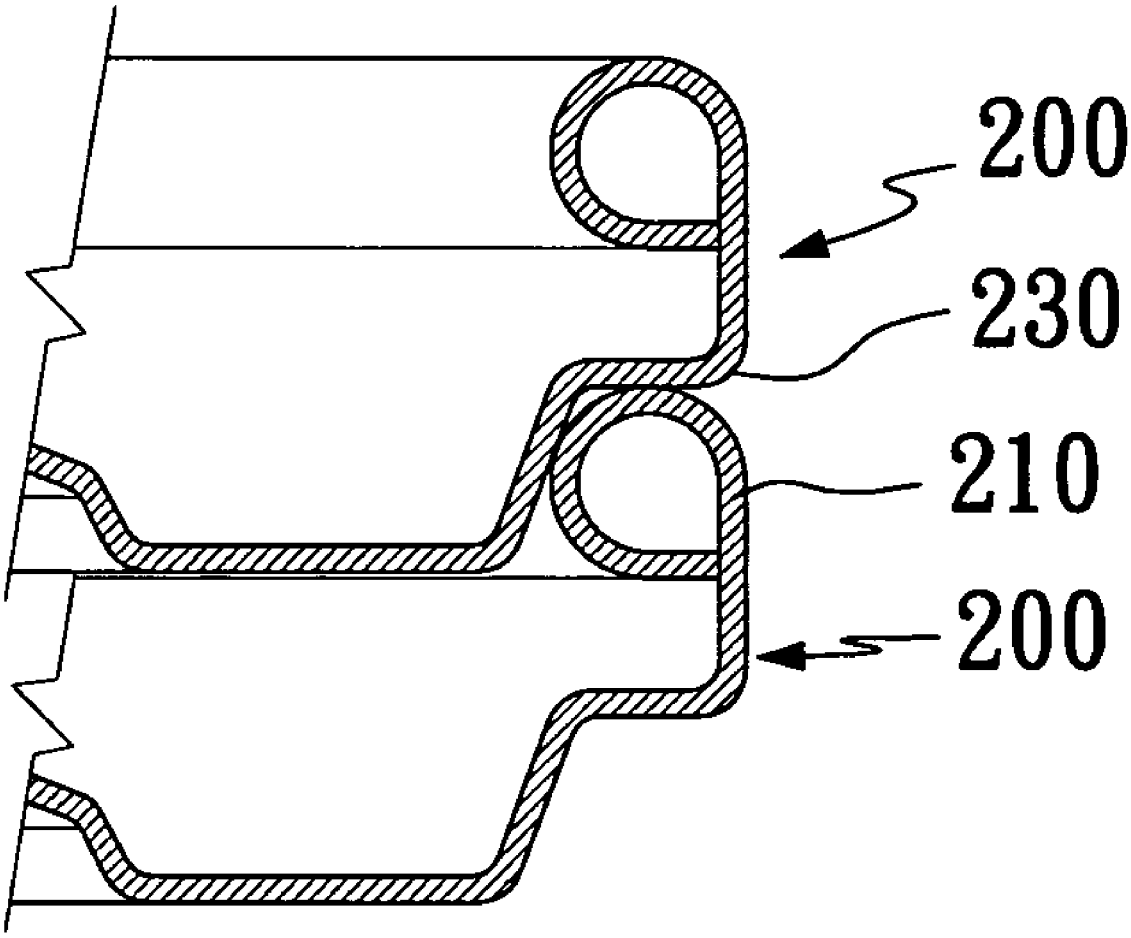
FIG. 5 is a sectional sketch for stacking a plurality of antennas according to the present invention.

Please refer to FIG. 3 and FIG. 4, which are a 3-D sketch of the present invention and a sectional sketch of a cross line AA' of FIG. 3. Between a bottom edge 221 of a base 220 of an antenna 200 and a side portion 222 of the antenna 200 is a containing slot 230, the top of the side edge 222 is a supporting ring 210 with a slippery surface, thus an upper edge 231 and a side edge 232 of the containing slot 230 may reserve an upper point 211 and a side point 212 of the supporting ring 210 of another antenna. Referring to FIG. 5, which is a stacking sketch of the present invention. In the meantime of stacking, the supporting ring 210 of the bottom antenna being contained in the containing slot 230 of the top antenna 200 may put a stop to that damaging the coating or the functions of the stacked antennas due to the conditions of falling down or delivery. On the other hand, the acceptancy for the supporting ring of the bottom antenna being into the containing slot of the top antenna shortens the height of the stacking, and then increases the room in a container to load into more antennas.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An improved structure for an edge of a disk body of an antenna, comprising:

a disk body; and a side portion;

wherein the side portion has a supporting ring and a containing slot that surround a circumference of the disk body, the supporting ring is located on a top part of the side portion, and the containing slot has an upper edge and a side edge, the supporting ring of a bottom antenna is reserved in the upper edge and the side edge of the containing slot of a top antenna while stacking a plurality of antennas, and the plurality of antennas are stacked sequentially in an order.

2. The improved structure for an edge of a disk body of an antenna according to claim 1, wherein the containing slot is located in between a bottom edge of a base of the antenna and a side edge of the antenna.

* * * * *